US005853160A

United States Patent [19]

Hurdis et al.

[11] Patent Number: 5,853,160

[45] Date of Patent: Dec. 29, 1998

[54] AERATOR VALVE ASSEMBLY

[75] Inventors: Jason R. Hurdis; James R. Burkhart, both of Princeton, Ill.

[73] Assignee: Martin Engineering Company, Neponset, Ill.

[21] Appl. No.: 996,862

[22] Filed: Dec. 23, 1997

[51] Int. Cl.[6] ..... F16K 31/40; B67B 7/24

[52] U.S. Cl. ..... 251/30.02; 137/315; 137/571; 222/3; 222/195

[58] Field of Search ..... 137/315, 571; 251/30.02; 222/3, 195

[56] References Cited

U.S. PATENT DOCUMENTS

| | | | |
|---|---|---|---|
| 2,635,634 | 4/1953 | Thurber, Jr. | 251/30.02 |
| 2,664,916 | 1/1954 | Conley | 251/30.02 |
| 3,070,112 | 12/1962 | Fricke et al. . | |
| 3,788,527 | 1/1974 | Matson . | |
| 3,827,451 | 8/1974 | Roob . | |
| 3,895,648 | 7/1975 | Stolle et al. . | |
| 3,942,684 | 3/1976 | Stetson . | |
| 4,051,982 | 10/1977 | Stetson | 222/195 |
| 4,073,464 | 2/1978 | Hansen et al | 251/30.02 |
| 4,346,822 | 8/1982 | Wadensten et al. . | |
| 4,676,402 | 6/1987 | Stetson . | |
| 4,703,869 | 11/1987 | De Rooy | 222/3 |
| 4,767,024 | 8/1988 | Rappen | 222/3 |
| 4,817,821 | 4/1989 | Simoens . | |
| 4,848,721 | 7/1989 | Chudakov | 251/30.02 |
| 5,441,171 | 8/1995 | Maury . | |
| 5,441,302 | 8/1995 | Johnson et al. . | |
| 5,490,777 | 2/1996 | Matsumoto . | |
| 5,605,349 | 2/1997 | Childree . | |
| 5,607,181 | 3/1997 | Richardson et al. . | |

FOREIGN PATENT DOCUMENTS

| | | |
|---|---|---|
| 0 021 999 | of 1981 | European Pat. Off. . |
| 2074786 | of 1971 | France . |
| 2214651 | of 1974 | France . |
| 78 20101 | of 1980 | France . |
| 1 165 955 | of 1964 | Germany . |

*Primary Examiner*—A. Michael Chambers
*Attorney, Agent, or Firm*—Lee, Mann, Smith, McWilliams, Sweeney & Ohlson

[57] ABSTRACT

An aerator valve assembly adapted to provide selective fluid communication between a supply of pressurized gas and a pressure vessel and adapted to provide selective fluid communication between the pressure vessel and a bulk material handling structure. The valve assembly includes a valve housing including a valve body, an end cap adapted to be connected to the supply of pressurized gas, and a piston seat having an outlet port adapted to provide fluid communication with the bulk material handling structure. The valve body includes a port adapted to provide fluid communication with the pressure vessel. A piston is located within a chamber of the valve body between the end cap and the piston seat. The piston is selectively slidable between an extended position wherein the piston creates a metal-to-metal seal with the piston seat to seal the outlet port closed and a retracted position wherein the seal is broken. The piston includes a diaphragm that is adapted to engage the piston seat and that includes a plurality of fluid passages adapted to provide fluid communication between the supply of gas and the port of the valve body. The piston includes a cylindrical skirt extending from the diaphragm that slidably engages a bearing on the interior wall of the valve body to provide proper piston alignment. A biasing member extends between the piston and the end cap and resiliently biases the piston from the retracted position to the extended position.

20 Claims, 3 Drawing Sheets

AERATOR VALVE ASSEMBLY

BACKGROUND OF THE INVENTION

The present invention is directed to an aerator valve assembly for use in connection with aerators such as air cannons, and in particular to an aerator valve assembly having a slidable piston including a cylindrical skirt for maintaining proper alignment of the piston and a plurality of fluid passages extending through a diaphragm of the piston.

Storage of granular and similar bulk material in bins, silos and the like creates many problems, particularly in the discharge of such bulk material as the bulk material has a tendency to refuse to flow due to bridging and other problems. Aerators such as air cannons are used in connection with the handling and aeration of bulk material. An aerator stores a large volume of air or other gas under pressure in a pressure tank and then quickly releases the air instantaneously into the storage receptacle such that the blast of air causes any obstructing bulk material to dislodge, thereby enabling the bulk material to flow freely from the storage receptacle.

SUMMARY OF THE INVENTION

A valve assembly is adapted to provide selective fluid communication between a supply of pressurized gas and a pressure vessel, and is also adapted to provide selective fluid communication between the pressure vessel and a storage bin. The valve assembly includes a valve housing having a valve body, an end cap and a piston seat. The valve body includes a first tubular member having a first end, a second end and a port adapted to provide fluid communication with the pressure vessel. The first tubular member includes an interior wall forming a chamber that is in fluid communication with the port. The end cap is attached to the second end of the first tubular member of the valve body and includes a fluid passage extending through the end cap that is adapted to provide fluid communication between the chamber of the first tubular member and the supply of pressurized gas. The piston seat includes a second tubular member having a first end sealingly engaged to the first tubular member of the valve body and a second end including an outlet port adapted to provide fluid communication with the storage bin.

A piston is located within the chamber of the first tubular member of the valve body between the end cap and the piston seat. The piston is selectively slidable within the chamber of the first tubular member between an extended position and a retracted position. The piston includes a central diaphragm and a cylindrical skirt which extends outwardly from the outer peripheral edge of the diaphragm. The diaphragm includes a first side and an opposing second side. One or more bores extend through the diaphragm from the first side to the second side and form respective fluid passages through the diaphragm. The first tubular member includes a cylindrical bearing that forms a portion of the interior wall of the first tubular member. The cylindrical skirt extends closely along and adjacent to the interior wall of the cylindrical bearing. A biasing member, such as a helical spring, extends between the end cap and the piston and resiliently biases the piston from the retracted position to the extended position.

When the piston is in the extended position, the fluid passages of the diaphragm of the piston provide fluid communication between the fluid passage of the end cap and the port of the first tubular member of the valve body, such that fluid communication is provided between the supply of pressurized gas and the pressure vessel, and the piston sealingly engages the piston seat and seals the outlet port of the piston seat from fluid communication with the port of the first tubular member. When the piston is in the retracted position, the piston allows fluid communication between the port of the first tubular member of the valve body and the outlet port of the piston seat such that fluid communication is provided between the pressure vessel and the storage bin.

BRIEF DESCRIPTION OF THE DRAWING FIGURES

DETAILED DESCRIPTION OF THE PREFERRED EMBODIMENT

Figure 1:
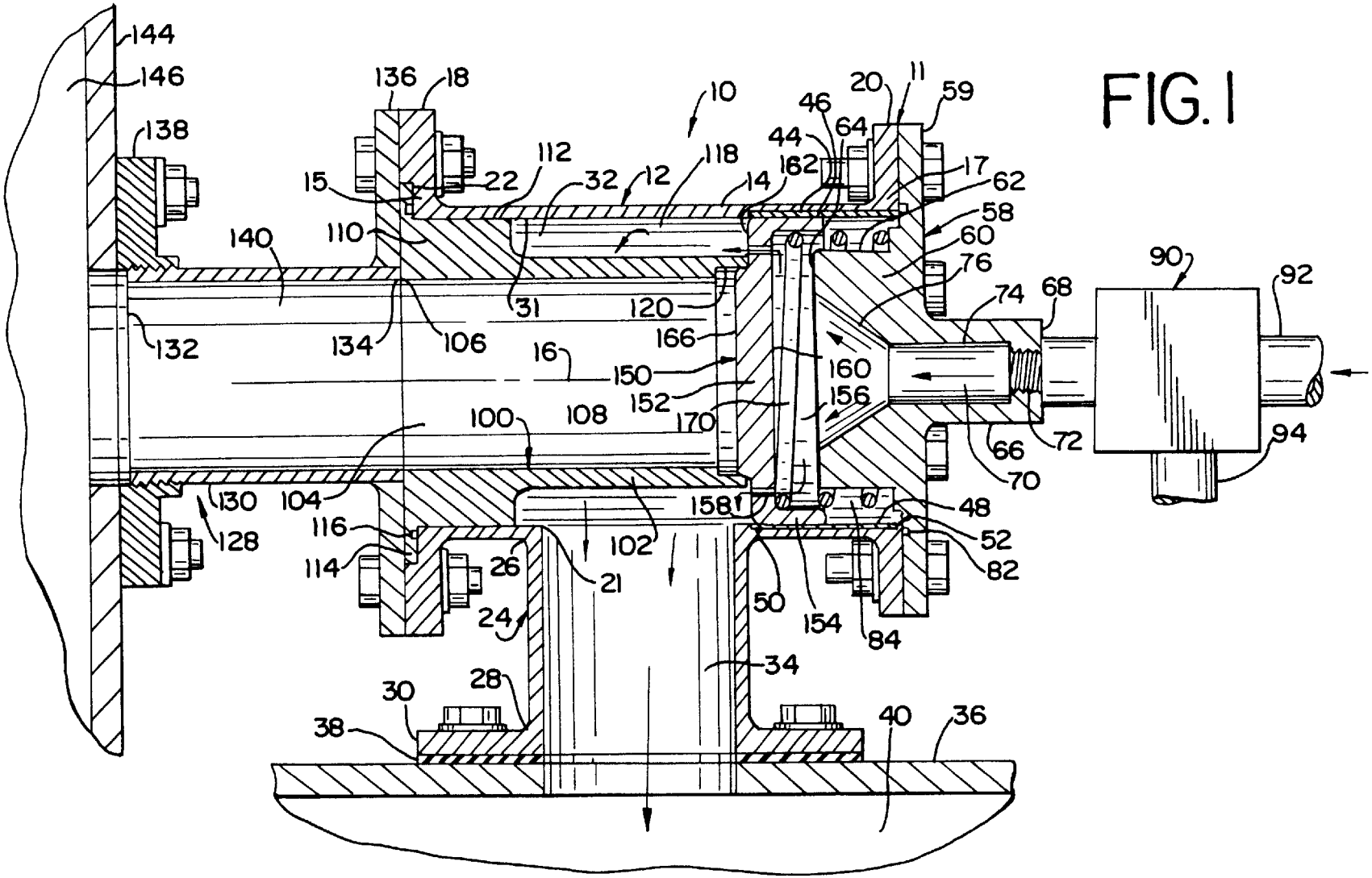
FIG. 1 is a cross-sectional view of the aerator valve assembly of the present invention shown with the piston in the extended charge position.

The aerator valve assembly 10 of the present invention includes a valve housing 11 having a generally T-shaped valve body 12. The valve body 12 includes an elongate hollow cylindrical conduit or tube 14 having a central longitudinal axis 16. The tube 14 includes a first end 15 having a first flange 18 and a second end 17 having a second flange 20. The tube 14 includes a port 21. The first flange 18 includes a circular recessed seat 22 that extends along the inner circumference of the flange 18. The valve body 12 also includes a generally centrally located cylindrical extension conduit or tube 24 having a first end 26 attached to the tube 14 and a second end 28 having a flange 30. The tube 14 includes an interior wall 31 forming a chamber 32 that is in fluid communication with the port 21. The extension tube 24 includes a fluid passage 34 that is in fluid communication with the port 21 and chamber 32. The flange 30 of the extension tube 24 is adapted to be connected to a pressure vessel or tank 36. A gasket 38 is preferably provided between the flange 30 and the pressure tank 36 to provide a gas-tight seal therebetween. The fluid passage 34 of the extension tube 24 is adapted to be placed in fluid communication with a chamber 40 of the pressure tank 36. The tubes 14 and 24 are preferably made entirely of metal.

The tube 14 of the valve body 12 includes a generally cylindrical seat 44 that extends along the circumference of the interior surface of the tube 14 and that extends longitudinally from the second end 17 of the tube 14 inwardly to a position adjacent to the port 21. A cylindrical bearing 46 is located within the cylindrical seat 44. The bearing 46 includes a cylindrical interior surface 48 that forms a portion of the interior wall 31 of the tube 14. The bearing 46 includes a first end 50 located adjacent to the port 21 and a second end 52 located at the second end 17 of the tube 14. The interior surface 48 of the bearing 46 has approximately the same diameter as the diameter of the interior wall 31 of the tube 14. The bearing 46 is preferably a self-lubricating bearing having a steel backing with a porous bronze inner-structure and a PTFE overlay. A preferred bearing is Model No. 104DU48 as manufactured by Garlock Bearing Inc.

The valve housing 11 also includes an end cap 58. The end cap 58 includes a generally circular plate 59 that is adapted to be removably attached in sealing engagement with the flange 20 of the tube 14. The end cap 58 includes a central hub 60 having a generally cylindrical side wall 62 and a generally circular and planar end wall 64 that projects from the plate 59 inwardly into the chamber 32. A generally cylindrical stem 66 extends outwardly from an exterior wall of the plate 59 to an outer end 68. A fluid passage 70 extends through the end cap 58 from the outer end 68 of the stem 66 to the interior end wall 64 of the hub 60. The passage 70 includes an internally threaded bore 72 located at the outer end 68 of the stem 66 that is in fluid communication with a generally cylindrical bore 74 that extends concentrically within the stem 66 into the hub 60. The cylindrical bore 74 is in fluid communication with a generally conical-shaped bore 76 that extends inwardly from the interior end wall 64 of the hub 60. The conical bore 76 converges inwardly from the interior end wall 64 of the hub 60 to the cylindrical bore 74. An elastomeric O-ring 82 is located between the flange 20 and the plate 59 to create a gas-tight seal therebetween. The central hub 60, the stem 66 and the fluid passage 70 are concentrically located about the central axis 16. As shown in FIG. 1, the cylindrical side wall 62 of the hub 60 is spaced apart from the cylindrical bearing 46 and the tube 14 creating an annular cavity 84 therebetween. The end cap 58 is preferably made entirely of metal.

The stem 66 of the end cap 58 is adapted to be connected to a valve 90, such that the valve 90 is in fluid communication with the fluid passage 70. The valve 90 is also in fluid communication with a supply of pressurized gas 92, such as air or nitrogen, and with a gas exhaust outlet 94. The valve 90 may be a solenoid valve and is adapted to selectively place the fluid passage 70 in fluid communication with either the supply of pressurized gas 92 or the gas exhaust outlet 94.

Figure 5:
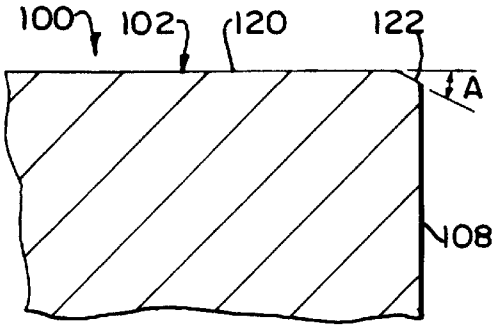
FIG. 5 is a partial cross-sectional view of the chamfered sealing surface of the piston seat.
Figure 3:
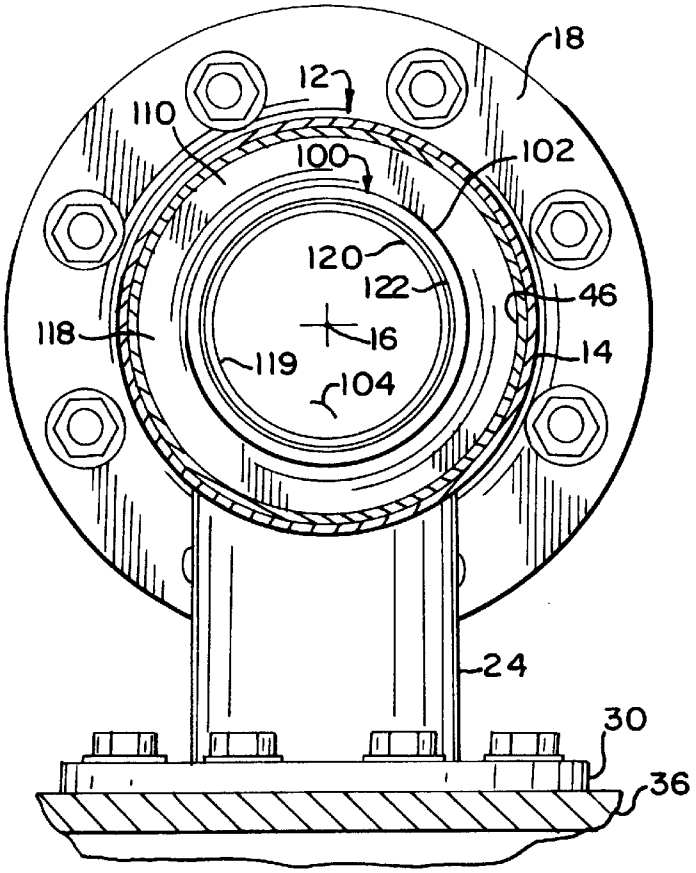
FIG. 3 is a cross-sectional view taken along line 3—3 of FIG. 2.

The valve housing 11 also includes a piston seat 100. The piston seat 100 includes a generally cylindrical tube 102 having a hollow bore forming a fluid passage 104. The tube 102 extends from a first end 106 to a second end 108. The first end 106 of the tube 102 includes a generally cylindrical base 110 that extends outwardly from and around the tube 102. The base 110 has a generally cylindrical outer wall 112. The outer wall 112 has a larger diameter than the diameter of the outer wall of the tube 102. The base 110 includes an outwardly extending circular flange 114. The piston seat 100 is located within the tube 14 of the valve body 12 such that the tube 102 is located concentrically about the axis 16. The outer wall 112 of the base 110 is located adjacent the interior wall 31 of the tube 14 and the flange 114 of the piston seat 100 is located within the circular seat 22 of the first flange 18 of the valve body 12. An elastomeric O-ring 116 is located between the flange 114 and the flange 18 to create a gas-tight seal therebetween. The portion of the tube 102 of the piston seat 100 that extends beyond the base 110 is spaced apart from the interior wall 31 of the tube 14 of the valve body 12 such that an annular chamber 118 is formed therebetween. The second end 108 of the tube 102 includes an outlet port 119 and a generally cylindrical recess 120 formed along the interior circumference of the tube 102. As best shown in FIG. 5, the second end 108 of the tube 102 includes an interior chamfered sealing surface 122. The sealing surface 122 is annular and forms the outlet port 119. The chamfered sealing surface 122 is disposed at an angle "A" to the internal wall of the tube 102 and to the central axis 16. The angle "A" is preferably approximately twenty-seven degrees. The piston seat 100 is preferably made entirely of metal, such as from cast aluminum.

The valve housing 11 also includes an extension tube assembly 128 preferably made entirely of metal. The extension tube assembly 128 includes a generally cylindrical extension tube 130 having a first end 132 and a second end 134. The second end 134 of the extension tube 130 includes a flange 136. The first end 132 of the extension tube 130 is threaded and is adapted to threadably engage a flange 138 having an internally threaded bore. The flange 136 of the extension tube 130 is adapted to be removably connected to the first flange 18 of the tube 14 thereby compressing the flange 114 of the piston seat 100 between the flanges 18 and 136. The tube 130 includes a fluid passage 140 that is in fluid communication with the fluid passage 104 of the piston seat 100. The tube 130 is located concentrically about the axis 16. The flange 138 is adapted to be connected by bolting, welding or the like to a bulk material handling structure such as a storage receptacle or bin 144 having a chamber 146 adapted to receive and have bulk granular material pass therethrough. The fluid passage 140 is adapted to be placed in fluid communication with the chamber 146 of the storage bin 144. The storage receptacle 144 may be a storage bin, silo, transfer chute, duct work or other bulk material handling structure.

The aerator valve assembly 10 also includes a piston 150. The piston 150 includes a generally circular plate-like diaphragm 152 and a generally cylindrical and annular skirt 154. The skirt 154 forms a hollow pocket 156 having an open end. The diaphragm 152 includes an outer peripheral edge 157. The skirt 154 extends along the peripheral edge 157 around the perimeter of the diaphragm 152 and extends outwardly and generally perpendicularly from the diaphragm 152. A plurality of bores 158 extend through the diaphragm 152 from an internal side 160 of the diaphragm 152 to an external side 162 of the diaphragm 152. The bores 158 form respective fluid passages. The bores 158 are located symmetrically with respect to one another about the center of the diaphragm 152 and about the axis 16. The diaphragm 152 includes an outwardly projecting raised portion 164 that is centrally located on the exterior side 162 of the diaphragm 152. The projection 164 is generally circular and includes a generally circular planar surface 166, and a circular angled sealing surface 168 that extends around the circular perimeter of the planar surface 166 and that is disposed at an angle to the planar surface 166. The bores 158 are located between the sealing surface 168 and the outer peripheral edge 157 of the diaphragm 152. The angled sealing surface 168 is disposed at the same angle as the chamfered sealing surface 122 of the piston seat 100 is disposed, such that the sealing surface 168 and the sealing surface 122 cooperatively and complimentarily mate and seal with one another when the sealing surfaces 122 and 168 are brought into engagement with one another. The piston 150 is preferably entirely made of metal, such as from cast aluminum.

The piston 150 is slidably located within the chamber 32 of the tube 14 of the valve body 12 between the end cap 58 and the piston seat 100. The skirt 154 of the piston 150 is located toward the end cap 58 and the projection 164 of the diaphragm 152 of the piston 150 is located toward the piston seat 100. The diaphragm 152 and skirt 154 of the piston 150 are located concentrically about the axis 16. The piston 150 is longitudinally slidable along the axis 16 between the piston seat 100 and the end cap 58. As shown in FIG. 1, the skirt 154 of the piston 150 slidably engages the interior surface 48 of the cylindrical bearing 46 of the valve body 12 around the exterior perimeter of the skirt 154. The skirt 154 also extends around the central hub 160 of the end cap 58 and into the annular cavity 84 formed between the hub 60 and the valve body 12. The skirt 154 is spaced transversely apart from the cylindrical side wall 62 of the hub 60 to provide an annular space therebetween.

A resilient helical spring 170 extends from the interior side 160 of the diaphragm 152 of the piston 150 to the interior surface of the plate 59 of the end cap 58. The spring 170 extends around the circumference of the cylindrical side wall 62 of the central hub 60 of the end cap 58 and extends within the pocket 156 of the skirt 154 adjacent to and along the internal perimeter of the skirt 154 of the piston 150. The spring 170 resiliently biases the piston 150 toward the piston seat 100 and toward the extended charge position. The spring 170 is preferably made entirely of metal.

Figure 2:
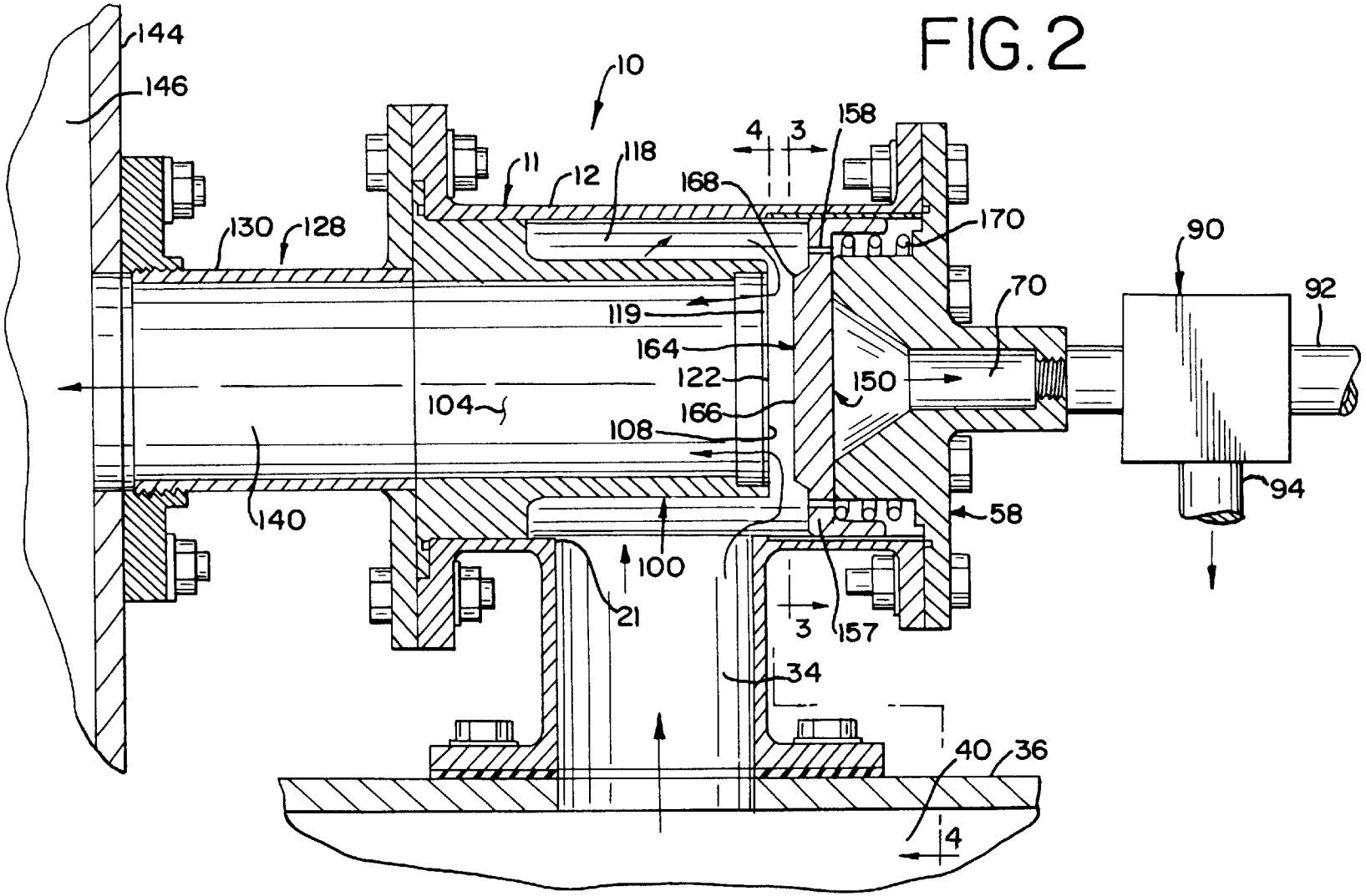
FIG. 2 is a cross-sectional view of the aerator valve assembly shown with the piston in the retracted discharge position.
Figure 4:
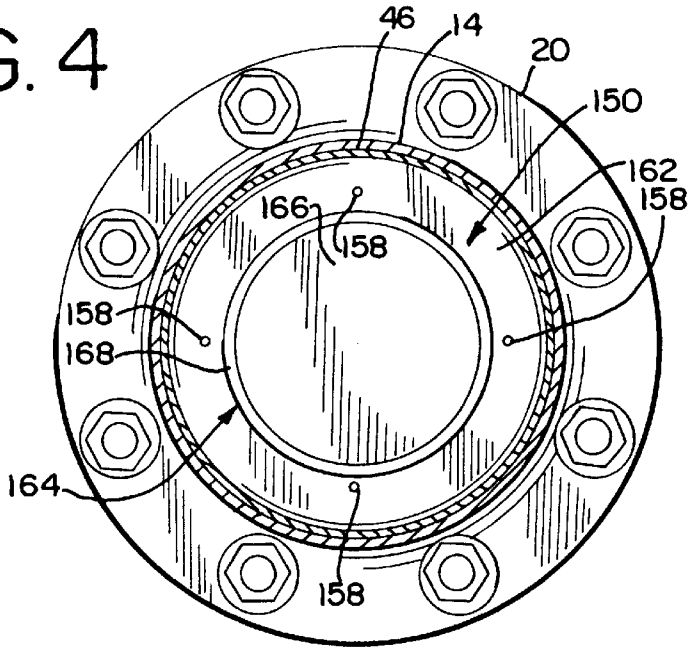
FIG. 4 is a cross-sectional view taken along line 4—4 of FIG. 2.

The spring 170 provides rapid movement of the piston 150 from the retracted discharge position, as shown in FIG. 2, to the extended charge position, as shown in FIG. 1, after evacuation of the compressed gas from the pressure vessel 36. The spring 170 is designed to have a transverse outer diameter such that the biasing force provided by the spring 170 is directed on the outer perimeter of the diaphragm 152 of the piston 150. This spring arrangement provides consistent piston concentricity and linear movement within the chamber 32 of the tube 14 and within the bearing 46 and thereby proper sealing of the piston 150 with the piston seat 100. The spring 170 reseals the piston 150 against the piston seat 100 after the discharge of the pressurized gas from the pressure vessel 36 thereby preventing any bulk material from passing through the outlet port 119 and entering the annular chamber 118, decreasing cycle times, and reducing shock or impact forces.

The piston 150 is longitudinally slidable along the axis 16 between an extended charge position as shown in FIG. 1, wherein the piston 150 sealingly engages the second end 108 and sealing surface 122 of the piston seat 100, and a retracted discharge position as shown in FIG. 2 wherein the piston 150 is spaced apart from the second end 108 of the piston seat 100. When the piston 150 is moved from the extended position to the retracted position, as shown in FIG. 2, the piston 150 compresses the spring 170. The interior side 160 of the diaphragm 152 may engage the end wall 64 of the end cap 58 and cover the fluid passage 70 in the retracted position as shown in FIG. 2, The cylindrical bearing 46 facilitates the longitudinal sliding movement of the internally disposed piston 150 and increases component life, eliminates metal scoring, and ensures consistent piston sealing and piston travel. The skirt 154 of the piston 150 provides improved piston alignment and control as the piston 150 slides longitudinally within the valve body 12.

In operation, when the piston 150 is in the extended charge position, as shown in FIG. 1, the sealing surface 168 of the piston 150 sealingly engages the chamfered sealing surface 122 of the piston seat 100 to create a metal-to-metal gas-tight seal therebetween. A fluid passage from the fluid passage 70 in the end cap 58, through the bores 158, and to the fluid passage 140 of the piston seat 100 is thus sealed closed by the piston 150. However, when the piston 150 is in the extended charge position as shown in FIG. 1, a fluid passage extends from the fluid passage 70 of the end cap 58 to the port 21 and fluid passage 34 of the extension tube 24 of the valve body 12 through the bores 158. As shown in FIG. 1, gas entering the passage 70 will flow therethrough into the pocket 156 formed by the skirt 154 of the piston 150, through the fluid passages 158 in the diaphragm 152 of the piston 150 to the annular chamber 118 formed between the piston seat 100 and the tube 14. The gas flows from the annular chamber 118 through the port 21 to the fluid passage 34 of the extension tube 24 and into the chamber 40 of the pressure tank 36. The gas flowing through the fluid passage 70 is blocked from entering the fluid passage 104 by the piston 150. The metal-to-metal seal between the piston 150 and the piston seat 100 eliminates the need to use rubber or other elastomeric materials to provide the piston to piston seat seal. Consequently high operating temperatures, and potential contamination or degradation of a rubber or elastomeric seal that could otherwise occur, are not detrimental to the operation of the aerator valve assembly 10. The aerator valve assembly 10 may be used in operating temperatures of up to approximately 2000° F. The valve assembly 10 may therefore be used in bulk material handling structures such as preheater towers for cement kilns.

When the pressure of the gas within the chamber 40 of the pressure tank 36 equals the pressure of the supply of gas 92, the pressure of the gas on each side 160 and 162 of the piston 150 is equal and the system is stagnate. When the desired gas pressure has been reached within the pressure tank 36, the valve 90 closes off the supply of pressurized gas 92 to the aerator valve assembly 10. When the gas in the pressure tank 36 is to be discharged into the storage bin 144, the valve 90 places the gas exhaust outlet 94 in communication with the passage 70 of the end cap 58. As shown in FIG. 2, gas located on the interior side 160 of the piston 150 is exhausted from the aerator valve assembly 10 through the passage 70 and the gas exhaust outlet 94 to a lower pressure location. This reduces the pressure of the remaining gas located between the piston 150 and the end cap 58 on the interior side 160 of the piston 150 and creates a pressure differential with the pressure of the gas exerting a force on the exterior side 162 of the piston 150. The pressure of the gas on the exterior side 162 of the piston 150 is now greater than the pressure of the gas exerting a force on the interior side 160 of the piston 150. The gas pressure differential creates a differential in the force applied to the exterior side 162 and interior side 160 of the piston 150 by the gas. The gas force acting on the exterior side 162 of the piston 150 from the higher pressure gas in contact with the exterior side 162, which force attempts to slide the piston 150 to the retracted position, is larger than the cumulative force exerted on the piston 150 by the pressure of the gas acting on the interior side 160 of the piston 150 plus the biasing force exerted by the spring 170 on the piston 150, which forces attempt to slide the piston 150 to the extended position. The differential in gas pressure, and the resulting difference in gas pressure forces applied to the piston 150, causes the piston 150 to slide from the extended charge position, as shown in FIG. 1, toward the end cap 58 to the retracted discharge position, as shown in FIG. 2, while compressing the spring 170.

The movement of the piston 150 from the extended position to the retracted position breaks the seal created between the piston 150 and the piston seat 100 and opens a fluid passage from the fluid passage 34 of the extension tube 24, through the port 21 to the passage 104 of the piston seat 100. Pressurized gas stored in the chamber 40 of the pressure tank 36 thereby flows through the passage 34 and port 21 to the annular chamber 118 wherein the gas flows between the piston 150 and the second end 108 of the piston seat 100, through the outlet port 119 to the passage 140. The gas flows from the passage 140 into the chamber 146 of the storage bin 144 to dislodge the granular material therein. The gas stored within the chamber 40 of the pressure tank 36 is discharged through the fluid passage 140 into the chamber 146 of the storage bin 144 at a discharge velocity of approximately mach one. Immediately after the gas is discharged from the pressure tank 36, the pressure of the gas located on the exterior side 162 of the piston 150 is reduced such that the spring 170 can slide the piston 150 from the retracted position, as shown in FIG. 2, to the extended position, as shown in FIG. 1, to reseal the piston 150 with the piston seat 100. The charging and discharging cycles of the aerator valve assembly 10 are then continued.

The threaded connection between the extension tube 130 and the flange 138 enables the easy removal and replacement of the aerator valve assembly 10 from the storage bin 144. In addition, as the flange 18 of the tube 14 is removably connected to the flange 136 of the tube 130, the tube 14 can be selectively removed from the tube 130 such that the piston seat 100, piston 150 and spring 170 may be easily removed and replaced from within the tube 14.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A valve assembly adapted to provide selective fluid communication between a supply of gas and a pressure vessel and adapted to provide selective fluid communication between the pressure vessel and a bulk material handling structure, said valve assembly comprising:

a valve housing including a valve body and a piston seat, said valve body including a first end, a second end, a port adapted to provide fluid communication with the pressure vessel, and an interior wall forming a chamber, said chamber being in fluid communication with said port, said second end of said valve body including a fluid passage adapted to provide fluid communication between the supply of gas and said chamber of said valve body, said piston seat having a first end removably engaged to said valve body and a second end having an outlet port adapted to provide fluid communication between said chamber of said valve body and the bulk material handling structure;

a piston located within said chamber of said valve body between said second end of said valve body and said piston seat, said piston being selectively slidable within said chamber between an extended position, wherein said piston sealingly engages said piston seat and thereby seals said outlet port closed, and a retracted position wherein said piston is spaced apart from said piston seat thereby opening said outlet port; and a biasing member extending between said second end of said valve body and said piston, said biasing member resiliently biasing said piston from said retracted position to said extended position;

whereby said piston seat is selectively removable from said valve body for inspection, repair and replacement.

2. The valve assembly of claim 1 wherein said valve body includes a first generally tubular member extending between said first end and said second end of said valve body, said first tubular member including said port of said valve body, said piston seat including a second generally tubular member having a first end and a second end, said first end of said second tubular member adapted to be placed in sealing engagement with said first tubular member, said second end of said second tubular member being located within said first tubular member and including said outlet port.

3. The valve assembly of claim 2 including an annular chamber formed between said first tubular member and said second tubular member, said annular chamber being in fluid communication with said port of said first tubular member.

4. The valve assembly of claim 1 including an extension tube removably connected to said first end of said valve body, said first end of said piston seat being removably secured to said first end of said valve body by said extension tube.

5. A valve assembly adapted to provide selective fluid communication between a supply of gas and a pressure vessel and adapted to provide selective fluid communication between the pressure vessel and a bulk material handling structure, said valve assembly comprising:

a valve housing including a valve body, an end cap and a piston seat, said valve body including a first end, a second end, a port adapted to provide fluid communication with the pressure vessel, and an interior wall forming a chamber, said chamber being in fluid communication with said port, said end cap being attached to said second end of said valve body and including a fluid passage extending therethrough adapted to provide fluid communication between the supply of gas and said chamber of said valve body, said piston seat having an outlet port adapted to provide fluid communication with the bulk material handling structure;

a piston located within said chamber of said valve body between said end cap and said piston seat, said piston being selectively slidable within said chamber between an extended position and a retracted position, said piston including a diaphragm and a skirt, said diaphragm having a first side, an opposing second side and an outer peripheral edge, said skirt extending along said outer peripheral edge of said diaphragm and outwardly from said diaphragm, said skirt being located closely adjacent to said interior wall of said valve body, said diaphragm including one or more fluid passages extending through said diaphragm from said first side to said second side; and a biasing member extending between said end cap and said piston, said biasing member resiliently biasing said piston from said retracted position to said extended position;

whereby when said piston is in said extended position said one or more fluid passages of said diaphragm provide fluid communication between said fluid passage of said end cap and said port of said valve body and said piston sealingly engages said piston seat and seals said outlet port of said piston seat from fluid communication with said port of said valve body, and when said piston is in said retracted position said piston allows fluid communication between said port of said valve body and said outlet port of said piston seat.

6. The valve assembly of claim 5 wherein said valve body includes a bearing forming a portion of said interior wall of said valve body, said piston being slidable between said extended position and said retracted position adjacent to said bearing.

7. The valve assembly of claim 6 wherein said bearing is generally cylindrical.

8. The valve assembly of claim 5 wherein said skirt is generally cylindrical and forms a pocket within said skirt.

9. The valve assembly of claim 8 wherein said biasing member comprises a spring, said spring having a first end located within said pocket of said skirt and a second end located adjacent to said end cap.

10. The valve assembly of claim 9 wherein said first end of said spring extends along and adjacent to said skirt.

11. The valve assembly of claim 9 wherein said end cap includes a hub extending inwardly into said chamber of said valve body, said spring extending around said hub.

12. The valve assembly of claim 11 wherein said hub of said end cap forms an annular cavity with said valve body adapted to receive said skirt of said piston and said second end of said spring.

13. The valve assembly of claim 11 wherein said hub of said end cap includes an end wall and said fluid passage of said end cap extends through said end wall, wherein said second side of said diaphragm of said piston is adapted to engage said end wall of said hub of said end cap and to cover said fluid passage in said end cap when said piston is in said retracted position.

14. The valve assembly of claim 5 wherein said piston seat is made of metal and said piston is made of metal such that when said piston is in said extended position and engages said piston seat a metal-to-metal seal is formed between said piston and said piston seat.

15. The valve assembly of claim 5 wherein said piston seat includes a sealing surface forming said outlet port, and said first side of said diaphragm of said piston includes a sealing surface, said sealing surface of said piston adapted to matingly engage said sealing surface of said piston seat when said piston is located in said extended position.

16. The valve assembly of claim 5 wherein said first side of said diaphragm of said piston includes a sealing surface adapted to matingly engage said piston seat, said one or more fluid passages of said diaphragm being located between said sealing surface of said diaphragm and said outer peripheral edge of said diaphragm.

17. The valve assembly of claim 5 wherein said valve body includes a first generally tubular member extending between said first end and said second end of said valve body, said first tubular member including said port of said valve body, said piston seat including a second generally tubular member having a first end and a second end, said first end of said second tubular member being in sealing engagement with said first tubular member, said second end of said second tubular member being located within said first tubular member and including said outlet port.

18. The valve assembly of claim 17 including an annular chamber formed between said first tubular member and said second tubular member, said annular chamber being in fluid communication with said port of said first tubular member.

19. The valve assembly of claim 18 wherein said valve body includes a third tubular member attached to said first tubular member, said third tubular member including a fluid passage in fluid communication with said port of said first tubular member, said fluid passage of said third tubular member adapted to provide fluid communication with the pressure vessel.

20. The valve assembly of claim 17 including an extension tube removably connected to said first end of said first tubular member of said valve body, said first end of said second tubular member being removably secured to said first end of said first tubular member by said extension tube.

* * * * *